US005251339A

United States Patent [19]

Piskula

[11] Patent Number: 5,251,339

[45] Date of Patent: Oct. 12, 1993

[54] RETRIEVING DEVICE

[76] Inventor: James Piskula, P.O. Box 26174, Milwaukee, Wis. 53226

[21] Appl. No.: 830,126

[22] Filed: Jan. 31, 1992

[51] Int. Cl.[5] ..... A47K 11/10

[52] U.S. Cl. ..... 4/255.01; 15/104.32

[58] Field of Search ..... 4/255.01, 255.02, 255.03, 4/255.04, 255.05, 255.06, 255.07, 255.08, 255.09, 255.10, 255.11, 255.12, 256.1; 15/104.32

[56] References Cited

U.S. PATENT DOCUMENTS

| | | | |
|---|---|---|---|
| 963,965 | 7/1910 | Weber | 4/255.01 |
| 1,051,992 | 2/1913 | Fisher et al. | 15/104.32 |
| 1,356,841 | 10/1920 | Utley | 15/104.32 |
| 1,985,813 | 12/1934 | Baden | 4/255.09 |
| 2,693,603 | 11/1954 | Lehmann | 4/257 |
| 2,811,724 | 11/1957 | Click et al. | 4/257 |
| 4,253,211 | 3/1981 | Mockel | 15/104.3 G |
| 4,301,554 | 11/1981 | Wojcicki | 4/206 |
| 4,307,476 | 12/1981 | Halstad | 4/661 |
| 4,932,080 | 6/1990 | Pino | 4/257 |
| 4,996,725 | 3/1991 | Pino | 4/257 |

FOREIGN PATENT DOCUMENTS

| | | | |
|---|---|---|---|
| 788778 | 1/1958 | United Kingdom | 4/255.01 |

*Primary Examiner*—Henry J. Recla
*Assistant Examiner*—Charles R. Eloshway
*Attorney, Agent, or Firm*—Quarles & Brady

[57] ABSTRACT

A device for retrieving objects flushed down a toilet consists of a hook for catching objects, a plug for closing an opening in a sewer pipe and a cable connected at one end to the plug and at the other end to the hook. In use, the hook is positioned in a sewer pipe downstream of the toilet and the plug is used to removably close an opening in the sewer pipe upstream of the toilet. Objects flushed down the toilet are retrieved by removing the plug from the opening and withdrawing the cable and hook and any objects caught by the hook from the sewer pipe through the opening.

4 Claims, 1 Drawing Sheet

RETRIEVING DEVICE

FIELD OF THE INVENTION

This invention relates generally to a device for retrieving objects from sewer pipes. More particularly, it relates to a device for retrieving objects, such as contraband, from sewer pipes in prisons and other correctional facilities where prisoners attempt to dispose of such objects by flushing them down a toilet.

BACKGROUND OF THE INVENTION

A problem particular to prisons is the need to prevent objects from being flushed through the prison sewage system. In many instances the objects are contraband, such as plastic bags of controlled substances, that the prisoner is trying to dispose of in order to avoid being caught in possession of these prohibited devices.

There is a need for retrieving such objects and also for retrieving clothing, bed clothes and the like to prevent them from clogging the sewer lines.

Although the need exists, at the present time there is no simple, practical device for retrieving objects, especially contraband, which have been flushed down a toilet.

SUMMARY OF THE INVENTION

Therefore, it is an object of this invention to provide a simple, practical device which will permit objects introduced into a sewer pipe to be retrieved.

Another object of this invention is to provide a device which catches objects, such as contraband, near the point of their introduction and prevents disruption of the entire sewage system.

Another object of this invention is to provide such a device which can be easily removed and cleaned.

The retrieving device of the present invention comprises a hook for catching solid objects which is positioned in a sewer pipe downstream of a toilet; a plug for closing an opening in the sewer pipe upstream of the toilet and a cable which is connected at one end to the hook and which extends to and is connected at the other end to the plug.

The aforementioned objects and other objects apparent to those skilled in the art result from the practice of the present invention.

DESCRIPTION OF THE PREFERRED EMBODIMENT

Without limiting the scope of the invention, the preferred embodiment of the invention is hereinafter set forth.

Figure 1:
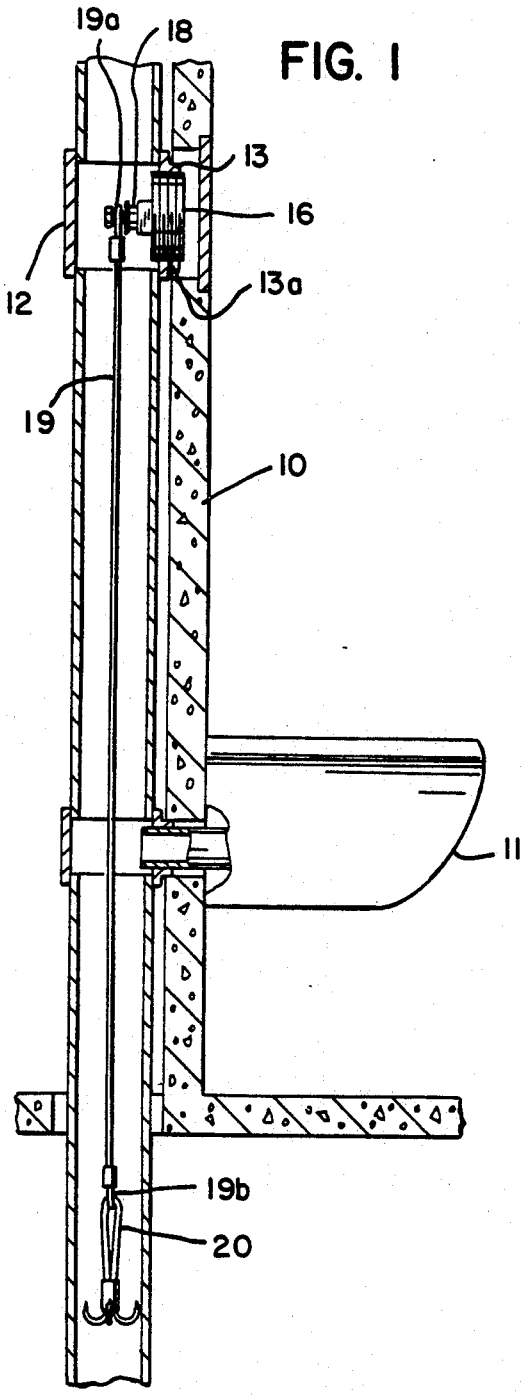
FIG. 1 is an elevational view, partly in section, showing a sewer pipe with the device of the present invention in place.

Turning to FIG. 1, a sewage pipe 10 is seen connected to a flush toilet 11. The upper end of pipe 10 is vented to the outside and is provided with a tee 12 which is located upstream of the toilet 11. The stem 13 of tee 12 has mouth **13*a*** which has internal threads.

Figure 2:
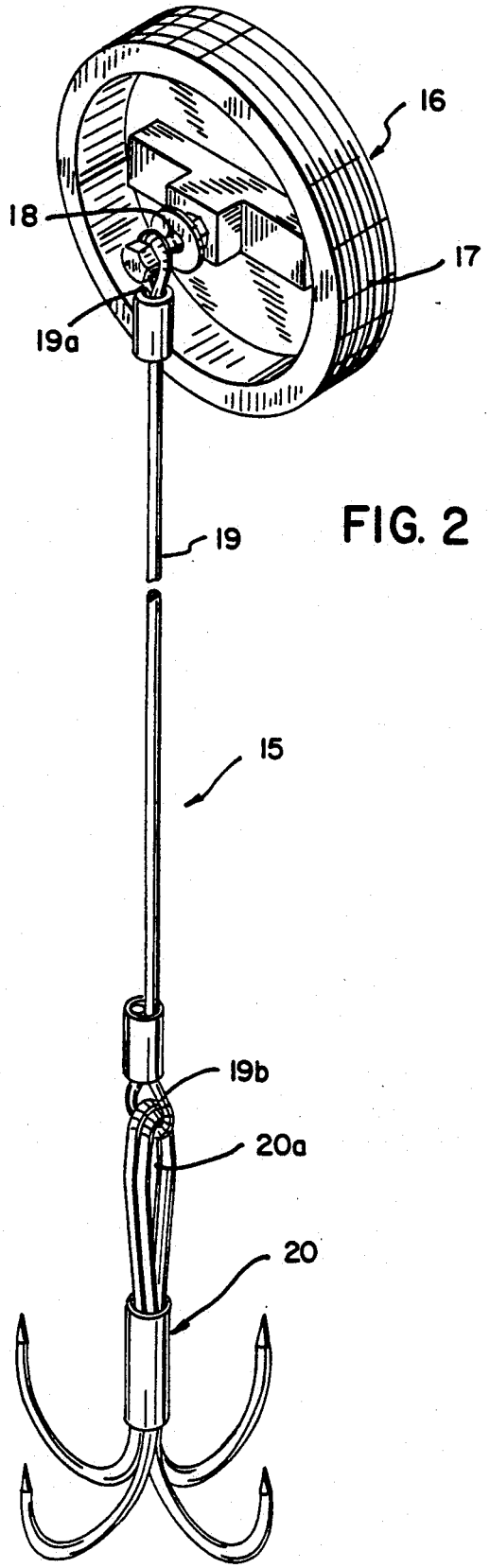
FIG. 2 is a perspective view of the device.

The retrieving device of the present invention is best seen in FIG. 2 and it is generally referred to as 15. As seen in FIGS. 1 and 2 it includes a plug 16 which has outer threads 17 that permit it to be screwed into and to close the mouth **13*a* of the tee 12**.

As seen in FIGS. 1 and 2, the plug 16 has an inwardly projecting arm 18 to which one end **19*a* of a cable 19 is attached. The other end of the cable 19*b* is attached to a hook 20. The hook 20, as seen in FIG. 1, is suspended by the cable 19 in the sewer pipe 10 downstream of the toilet 11 so that the hook 20 can catch any solid object flushed down the toilet 11**.

Objects caught by the hook 20 can be readily retrieved by unscrewing and removing the plug 16 from the open mouth **13*a* of the tee 12 and withdrawing the cable 19, the hook 20 and any object(s) caught by the hook through the open mouth 13*a*. Once the object has been retrieved, the retrieving device 15 can be cleaned and reset with the hook 20 repositioned and the plug 16 screwed back in place in the mouth 13*a*** as shown in FIG. 1.

In FIG. 2, the preferred embodiment of the retrieving device 15 can be seen in greater detail. As seen therein, the hook 20 is a quad hook and the cable 19 is connected at one end **19*a* to the arm 18 and at the other end to an eye 20*a* of the hook 20. As a result, the cable 19 hangs down from the arm 18** without kinking.

There are, of course, many alternate embodiments and modifications of the invention which are intended to be included within the scope of the following claims. For example, in place of a conventional hook an equivalent object catching mechanism can be used. Therefore, the term "hook" as used herein is intended to include equivalents.

I claim:

1. In combination with a sewer pipe and a flush toilet emptying into the sewer pipe, a retrieving device to catch objects flushed down said toilet into the sewer pipe and to permit said objects to be retrieved from the sewer pipe without them passing back through said toilet, said retrieving device comprising:

(a) hook means removably positioned in a sewer pipe at a point downstream of where the toilet empties into the sewer pipe;

(b) cable means attached at one end to the hook means; and (c) removable plug means attached to the other end of the cable means, said plug means closing an opening in the sewer pipe so that said plug means when it is removed from the opening in the sewer pipe can serve as a handle by which said hook means and any objects caught thereby can be removed from the sewer pipe through said opening without having to pass again through said toilet.

2. A retrieving device for retrieving objects flushed down a toilet into a sewer pipe, said device comprising:

(a) a hook means for catching objects passing through a sewer pipe downstream from a toilet;

(b) a cable connected at one end to the hook means; and (c) a plug means attached to the other end of the cable for closing an opening in the sewer pipe, said plug means being removable from the opening so that it can be used as a handle to withdraw the cable and the hook with any objects caught thereby through the opening without said cable, hook and objects having to pass through the toilet.

3. A device of claim 2 in which the hook has an eye and the cable is connected at one end to the eye of the hook.

4. A device of claim 2 in which the plug has an arm and the other end of the cable is connected to the arm of the plug.

* * * * *